US008813464B2

(12) United States Patent
Leidig

(10) Patent No.: US 8,813,464 B2
(45) Date of Patent: Aug. 26, 2014

(54) APPARATUS AND METHOD FOR ALIGNING PACKAGES

(75) Inventor: Juergen Leidig, Frankenhardt (DE)

(73) Assignee: Robert Bosch GmbH, Stuttgart (DE)

( * ) Notice: Subject to any disclaimer, the term of this patent is extended or adjusted under 35 U.S.C. 154(b) by 125 days.

(21) Appl. No.: 13/256,754

(22) PCT Filed: Feb. 23, 2010

(86) PCT No.: PCT/EP2010/052268

§ 371 (c)(1),
(2), (4) Date: Sep. 15, 2011

(87) PCT Pub. No.: WO2010/118907

PCT Pub. Date: Oct. 21, 2010

(65) Prior Publication Data

US 2012/0023873 A1 Feb. 2, 2012

(30) Foreign Application Priority Data

Apr. 16, 2009 (DE) ..... 10 2009 002 441

(51) Int. Cl.
*B65B 43/12* (2006.01)
*B65B 69/00* (2006.01)

(52) U.S. Cl.
CPC ..... *B65B 69/0008* (2013.01)
USPC ..... 53/457

(58) Field of Classification Search
CPC ..... B65B 43/39; B65B 43/30; B65B 43/26; B65B 43/34; B65B 69/0008
USPC ..... 53/457, 458, 468, 425, 432, 566, 434, 53/492, 512, 387.1
See application file for complete search history.

(56) References Cited

U.S. PATENT DOCUMENTS

| | | | | |
|---|---|---|---|---|
| 2,730,254 | A | 1/1956 | Sabaroff et al. | |
| 3,649,993 | A * | 3/1972 | Sauer | 15/304 |
| RE28,350 | E * | 3/1975 | Lerner | 53/459 |
| 4,124,969 | A * | 11/1978 | Peyton | 53/382.3 |
| 4,478,023 | A * | 10/1984 | Becker | 53/382.3 |
| 6,430,901 | B1 * | 8/2002 | Domansky et al. | 53/492 |
| 6,474,040 | B1 * | 11/2002 | Ours et al. | 53/133.3 |
| 6,474,046 | B1 * | 11/2002 | Ours et al. | 53/432 |
| 2005/0160704 | A1 * | 7/2005 | Miksch | 53/492 |
| 2007/0193229 | A1 * | 8/2007 | Stackley et al. | 53/457 |
| 2008/0110136 | A1 * | 5/2008 | Liu et al. | 53/492 |
| 2008/0229713 | A1 * | 9/2008 | Ford | 53/443 |
| 2009/0208316 | A1 | 8/2009 | Mayer et al. | |

FOREIGN PATENT DOCUMENTS

| | | |
|---|---|---|
| DE | 19827059 | 12/1999 |
| WO | 9821099 | 5/1998 |
| WO | WO 9821099 A1 * | 5/1998 |
| WO | 2008155183 | 12/2008 |
| WO | WO 2008155183 A1 * | 12/2008 |

OTHER PUBLICATIONS

PCT/EP2010/052268 International Search Report.

* cited by examiner

*Primary Examiner* — Stephen F Gerrity
*Assistant Examiner* — Eyamindae Jallow
(74) *Attorney, Agent, or Firm* — Michael Best & Friedrich LLP

(57) ABSTRACT

An apparatus and a method for aligning a package are proposed, wherein the apparatus comprises the following: a vacuum chamber (32) in which a vacuum is created such that a package (10), which is located inside the vacuum chamber (32), unfolds, and at least one fixing means (22) which fixes the aligned package (10).

17 Claims, 2 Drawing Sheets

APPARATUS AND METHOD FOR ALIGNING PACKAGES

BACKGROUND OF THE INVENTION

The invention is based on an apparatus and a method for aligning packages. An apparatus for the filling, evacuation and closure of packages is already known from DE 198 27 059 A1. An additional conveying device comprises evacuating chambers and a folding and sealing station. The package containers are introduced into the evacuating chambers without prefolding of their head region, so that the full cross section of the package is available there for evacuation.

An apparatus and a method for removing a cover foil from a container are known from DE 10 2006 005 700 A1. The apparatus comprises at least one gripping device, means for creating a predetermined breaking point being provided on the container. Following the creation of the predetermined breaking point, the gripping device grips a gripping surface delimited by the predetermined breaking point, in order to remove the cover foil from the container.

An apparatus and a method for removing a sterile object from a sterile package are known from DE 10 2007 027 878. To this end, a clamping device clamps a first part-region of the sterile package. A cutter creates a slot in the sterile package, while a removal device removes the object from the sterile package through the slot.

SUMMARY OF THE INVENTION

The object of the invention is to align a package surrounding a container in a simple manner such that the package can easily be opened. The apparatus and method according to the invention for aligning packages have the comparative advantage that a folded-in package flap is aligned in a simple manner for the purpose of the subsequent mechanical opening of the package. A manual unfolding or alignment can be dispensed with. This is made possible by the fact that a package surrounding the container is brought into a vacuum chamber. After this, the vacuum chamber is evacuated. An underpressure is thereby created in the surrounds of the package, so that the gas in the package expands and a folded-in flap of the package unfolds, so that the package aligns itself.

In addition, at least one fixing means is provided, which holds the aligned package in the desired position. In particular, a collapse of the erected package following a change in pressure conditions is prevented and a subsequent reliable opening of the package is enabled.

In an expedient refinement of the invention, the fixing means comprises at least one clamping plate, preferably at least two clamping plates. A retraction of the generally rectangular package over the entire length on the side which is later to be cut open can thus be prevented. Particularly preferably, the elements of the fixing means, such as, for example, the clamping plates or rollers, are movable relative to one another. A purposeful fixing and tensioning following alignment of the package is thereby facilitated.

In one expedient refinement, it is provided that, following the evacuation of the evacuating chamber, the gas in the package is also evacuated. The inflated package is thereby reflattened, though without abandoning the desired position of the unfolded package. In one expedient refinement, a ventilation and/or disinfection of the vacuum chamber is provided. This ventilation of the vacuum chamber can preferably be realized using filtered air. A disinfectant can be introduced into the ventilation line via an atomizer. Sterility, as is necessary, in particular, for pharmaceutical applications, is thereby achieved.

BRIEF DESCRIPTION OF THE DRAWINGS

An illustrative embodiment of the apparatus and the method for aligning packages is represented in the drawing and is described in greater detail below.

DETAILED DESCRIPTION

Figure 1:
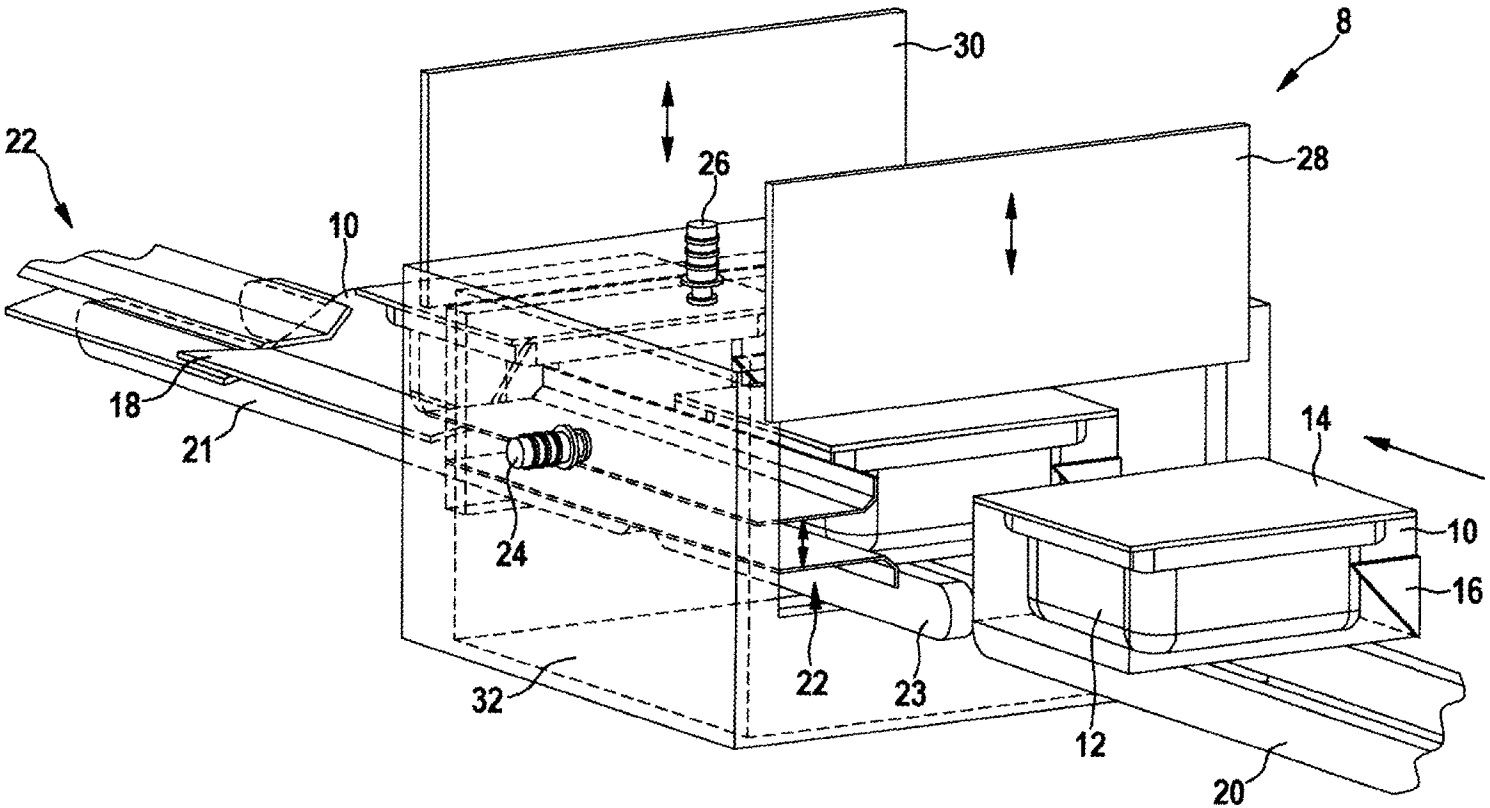
FIG. 1 shows a perspective view of the apparatus for aligning packages.

An apparatus 8 for aligning packages 10 comprises a number of components. A feed 20 transports a container 12 surrounded by the package 10. The top side of the container 12 is in turn closed off with a cover foil 14. Inside the container 12 can be arranged, for instance, receptacles which are to be filled, such as vials or presterilized syringes, which receptacles are supplied in the container 12, for instance, for filling with pharmaceuticals. The package 10 has at least one folded-in region, such as, for instance, a flap corner 16, which—represented by way of example in FIG. 1—is folded in such a way that a rectangular outer contour is formed.

The feed 20 conveys the container 12 surrounded by the package 10 into a vacuum chamber 32. The vacuum chamber 32 has a displaceable inlet 28, which for feeding of the container 12 to the inside of the vacuum chamber 32 is open. On the other side, the vacuum chamber 32 is delimited by an outlet 30, which can likewise be opened, so that the container 12 with the then aligned package 10 can leave the interior of the vacuum chamber 32. On a side wall of the vacuum chamber 32 a vacuum connection 24 is provided, for the application of a vacuum inside the vacuum chamber 32. On the top side of the vacuum chamber 32, a ventilation connection 26 is arranged. Inside the vacuum chamber 32, at least one fixing means 22 is provided. The outer edges thereof preferably run parallel to the direction of transport of the container 12. The fixing means 22 preferably consists of two clamping plates, which can be moved upward and downward perpendicular to the direction of transport. These are designed to serve to leave an aligned package 10 in the aligned state. The fixing means 22 is also arranged outside the vacuum chamber 32 in order to leave the package 10 in the aligned state also outside the vacuum chamber 32. Inside the vacuum chamber 32 there is a transport means decoupled from the feed 20, which transport means delivers the container 12 present inside the vacuum chamber 32 via the open outlet 30 to a lead-off device 21, which takes charge of the onward transport of the container 12.

Figure 2:
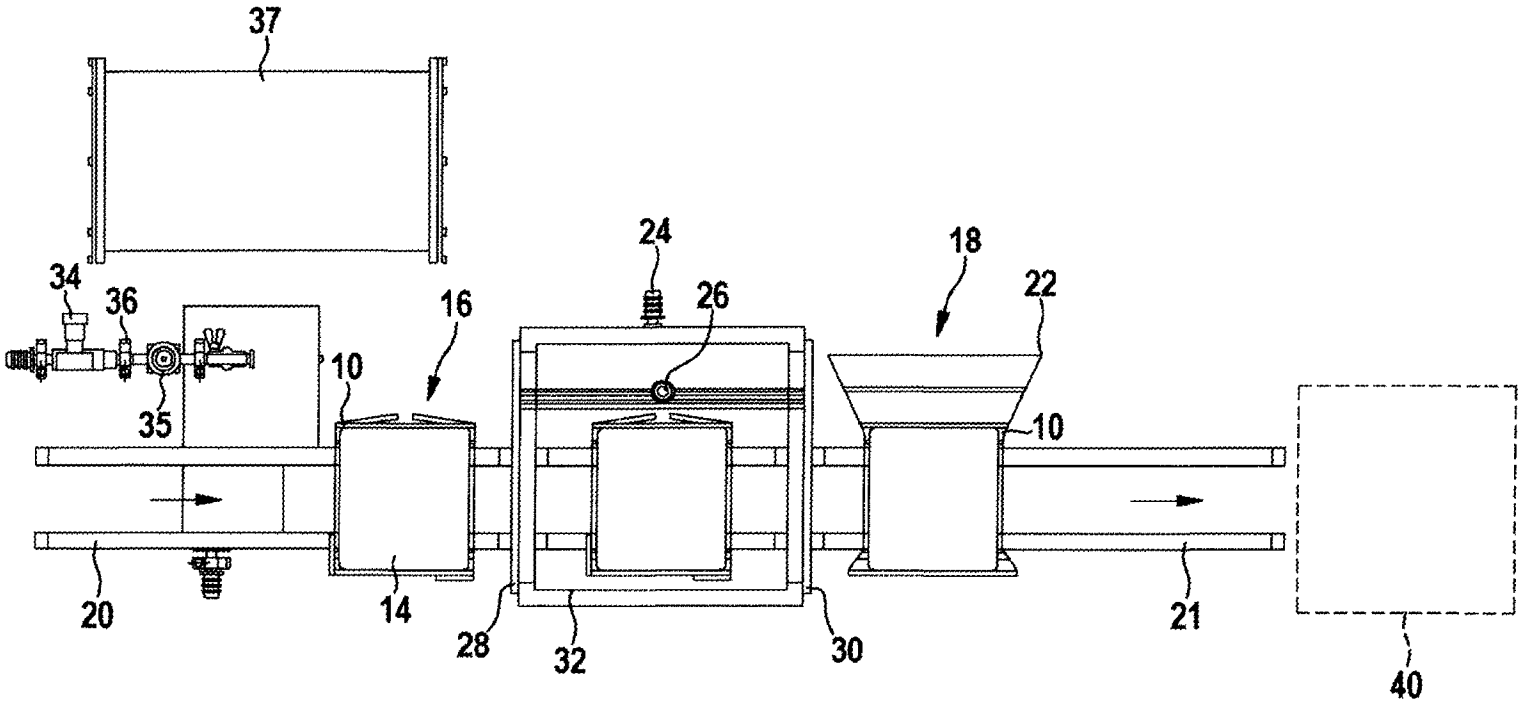
FIG. 2 shows a top view of the apparatus with still further components.

In the view according to FIG. 2, the feed 20 which transports the container 12, with folded-in flap 16 and provided with the package 10, into the interior of the vacuum chamber 32 can once again be discerned. For the application of a vacuum in the vacuum chamber 32, a vacuum pump 34 with valve 35 and corresponding control mechanism 36 is provided, wherein a vacuum recipient 37 receives the gas, e.g. air, evacuated from the vacuum chamber 32. Inside the vacuum chamber 32, the package 10 is aligned by transforming the folded-in flap corner 16 into an aligned flap corner 18 through the application of a vacuum. The thus aligned package 10 is held in this position by the fixing means 22 and fed from inside the vacuum chamber 32 by means of a transport means 23 and a lead-off device 21 to an optional bag opening device 40.

This opens the package 10 on the aligned package side, for instance by lateral cutting open of the package 10.

The described apparatus 8 for aligning packages 10 works as follows. The container 12, with the as yet unaligned package 10 surrounding it, is brought inside the vacuum chamber 32. At the vacuum chamber 32, the inlet 28 and the outlet 30 are now closed. The vacuum chamber 32 is now evacuated by means of the vacuum pump 34 and the vacuum recipient 37. To this end, the vacuum pump 34 is connected by a line (not represented), via the vacuum connection 24, to the vacuum chamber 32. The gas in the package 10 is located after the evacuation in an underpressure environment. As a result, the gas in the package 10 expands and inflates the latter. The flap 16 which is folded in toward the container middle hence moves away from the container middle and protrudes outward. In this state the package 10 is aligned, i.e. the outer contours of the package 10 are in a state which enables an almost maximum volume of the package 10. In particular the side edges of the package 10 are now distanced as far as possible from the container 12, which makes it easier to open the package 10 without damage to the container 12.

The thus aligned package 10 with aligned flap 18 is prevented by the fixing means 22 from retracting from the aligned state. For, in particular in the ventilation of the vacuum chamber 32, the outer edge of the package 10 would otherwise move back in the direction of the container 12. As the fixing means 22, one or more clamping plates could be used, which clamping plates are configured such that they are movable up and down. The position and geometry of the fixing means 22 are in any event chosen such that they mechanically clamp or grip and tension in a secure manner at least a side region or a side edge of the aligned package 10. A different realization of the fixing means 22, e.g. in the form of a gripper, an air suction device, or similar, would also be possible. In any event, a certain force must be applied to the package 10 in order to prevent retraction and tension the package 10. The tensioning of the flap 16 and/or of the package could also be realized via driven rollers in the clamping plate (as an example of a fixing means 22).

The package 10 frequently consists at least partially of a gas-permeable, but non-water-permeable material, which acts as a filter, preferably as a sterile filter. For this, a non-woven fabric, for instance, is suitable. In general, the package 10 is not closed in an airtight manner, so that the package 10 too could be evacuated, which should be done, however, only as little as possible. To this end, particularly preferably, a short, flash vacuum is applied for a duration of about 1-2 s in the vacuum chamber 32. The sealed seams of the package 10 should thus be designed such that they withstand this pressure shock.

Following the alignment of the package 10 with now unfolded flap 18, the vacuum chamber 32 is reventilated. Air, which may possibly have been previously filtered, is supplied via the ventilation connection 26. Via an atomizer (not specifically represented), a disinfectant could also be introduced into the ventilation line connected to the ventilation connection 26. A disinfection could also be realized in a disinfection chamber separate from the vacuum chamber 32.

The fixing means 22 open up a gap and free the unfolded flap 18 and thus the whole of the aligned package 10 for onward transport out of the vacuum chamber 32. Following ventilation of the vacuum chamber 32, the inlet 28 and the outlet 30 open. The aligned package 10 is transported away out of the vacuum chamber 32 by the transport means 22 and the lead-off device 21.

Also outside the vacuum chamber 32, fixing means 22 are arranged, which fixing means prevent the unfolded flap corner 18 from folding in again. To this end, one or two plates, the side edges of which are aligned parallel to the direction of transport, are provided. This ensures that the aligned package 10 remains in this state until it is opened. If need be, yet further stations can be passed through before the package opening device 40 is reached. For instance, the package 10 could be disinfected in a separate disinfection chamber and then redried in a drying section. For these further treatment steps also, suitably arranged fixing means 22 ensure that the package 10 remains in the aligned state.

The aligned packages 10 are now fed, for instance, to a package opening device 40. There, the unfolded flap corner 18 or the aligned package 10 is cut open, so that the container 12 can be removed from the package 10. Next, the cover foil 14 is removed, so that the receptacles present in the container 12, e.g. vials, syringe receptacles or similar, can be removed and supplied for further treatment. These receptacles can be filled with pharmaceuticals, for instance, in a filling and closing device. These receptacles, such as disposable syringes, are supplied pre-sterilized in the container 12 (box, tub) packed in a package 10. As a result of the described apparatus for aligning packages 10, the packages 10 can be supplied in a predefined position of the package opening device 40 which is favorable for the opening of the package 10. A manual alignment, in particular, is thereby rendered unnecessary, so that the package 10 can be opened without manual preparatory action.

What is claimed is:

1. An apparatus for aligning a package (10), comprising at least one openable and closeable vacuum chamber (32), a mechanism to feed packages into the open vacuum chamber (32), a mechanism to create a vacuum in the closed vacuum chamber (32), whereby a package (10) with a folded-in flap that has been moved into the open vacuum chamber (32) via the feed mechanism (20) aligns itself due to the vacuum created in the closed vacuum chamber (32) to be an aligned package with the flap being unfolded, the vacuum chamber further having at least one fixing means (22) for fixing the aligned package (10) by grasping the unfolded flap, and a mechanism to feed the aligned package (10) out of the open vacuum chamber (32) to a package opening device (40) for opening of the package (10).

2. The apparatus as claimed in claim 1, characterized in that the fixing means (22) is movably configured.

3. The apparatus as claimed in claim 1, characterized in that the fixing means (22) tensions the aligned package (10).

4. The apparatus as claimed in claim 1, characterized in that the fixing means (22) comprises at least one of a clamping plate, a guide, and a roller.

5. The apparatus as claimed in claim 1, characterized in that the fixing means (22) comprises at least two clamping plates, which are movable relative to each other.

6. The apparatus as claimed in claim 1, characterized in that the vacuum chamber (32) has a ventilation connection (26), via which a gas can be fed to the vacuum chamber (32).

7. The apparatus as claimed in claim 6, wherein the gas that can be fed to the vacuum chamber (32) is sterile.

8. The apparatus as claimed in claim 1, wherein the package opening device (40) is provided such that the aligned package (10) is fed to the package opening device (40) while retaining the action of the fixing means (22).

9. A method for aligning packages comprising:

opening a vacuum chamber (32);

moving at least one package (10) along a feed (20) into the vacuum chamber (32), the package (10) having a folded-in flap, closing the vacuum chamber;

applying a vacuum in the vacuum chamber (32), so that the package (10) is at least partially inflated and aligns itself to be an aligned package with the flap being unfolded due to the vacuum generated in the vacuum chamber; and grasping the unfolded flap.

10. The method as claimed in claim 9, characterized in that the unfolded flap is grasped with at least one of a clamping plate, a guide, and a roller.

11. The method as claimed in claim 10, characterized in that the grasping of the unfolded flap of the aligned package (10) is released for the removal of the aligned package (10) from the vacuum chamber (32).

12. The method as claimed in claim 9, characterized in that the aligned package (10) is tensioned in an aligned state.

13. The method as claimed in claim 9, characterized in that a vacuum is applied in the form of a vacuum shock.

14. The method as claimed in claim 13, wherein the vacuum shock has a duration of about 1-2 seconds.

15. The method as claimed in claim 9, characterized in that the aligned package (10) is opened.

16. The method as claimed in claim 9, characterized in that the vacuum chamber (32) is ventilated.

17. The method as claimed in claim 16, wherein the vacuum chamber (32) is ventilated with disinfected gas.

* * * * *